US006688740B2

(12) United States Patent
Driggers

(10) Patent No.: US 6,688,740 B2
(45) Date of Patent: Feb. 10, 2004

(54) STACK ACCESSORY FOR PRINTER

(75) Inventor: Matt G. Driggers, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/001,377

(22) Filed: Oct. 19, 2001

(65) Prior Publication Data

US 2003/0076397 A1 Apr. 24, 2003

(51) Int. Cl.[7] ..... B41J 2/01
(52) U.S. Cl. ..... 347/104; 400/162
(58) Field of Search ..... 347/104; 271/131–134, 271/35, 23, 162–165, 119, 3.05, 3.06, 3.07; 400/624–629, 608.2, 605

(56) References Cited

U.S. PATENT DOCUMENTS 4,369,962 A * 1/1983 Spiro ..... 271/11
4,888,602 A * 12/1989 Watanabe et al. ..... 346/134
5,384,619 A * 1/1995 Yokomizo et al. ..... 355/200
5,934,664 A * 8/1999 Murayama et al. ..... 271/118
D431,046 S 9/2000 Dwyer et al.
6,167,231 A 12/2000 Blackman et al.
6,244,588 B1 * 6/2001 Tsubakimoto et al. ..... 271/164
6,293,716 B1 9/2001 Driggers et al.
6,332,068 B2 12/2001 Blackman et al.
6,457,886 B1 * 10/2002 Meier ..... 400/541

* cited by examiner

*Primary Examiner*—Stephen D. Meier
*Assistant Examiner*—Ly T Tran

(57) ABSTRACT

A stack accessory for a printer attaches as a module to a printer and provides a source of media. Media originates from a stack within the module passing media from the bottom of the stack to the printer. The top of the stack remains open to replenish the media stack without interrupting printing operations. The stack accessory serves particularly well as an envelope feed mechanism supporting a large inventory of envelopes therein. Large scale and continuous envelope printing operations result. Overall, a stack accessory under the present invention converts a generally conventional printer into a high-volume printing device enjoying uninterrupted printing operations associated with replenishing a supply of media fed therethrough.

2 Claims, 5 Drawing Sheets

STACK ACCESSORY FOR PRINTER

BACKGROUND OF THE INVENTION

The present invention relates generally to printing devices, and particularly to infeed devices supplying media to a printer.

Most printing devices have various media source or infeed alternatives. For example, the most common primary media source for a printer is a media input tray holding sheet-form media. The tray, removable from the printer, holds a stack of media therein. Movable wall structures within configure the tray to hold, as an organized stack, media of selected size. A user loads or replenishes a supply of media by pulling the tray from the printer and dropping media from above onto a stack receptacle defined by the movable wall structures. When properly configured and located within the printer, the tray presents the top member of the stack of sheet-form media to a pick mechanism. In some printers, multiple such input trays positioned within the printer allow selection among different sheet-form media stacks. A pick mechanism collects from the media stack the top member and introduces it into the feed path of the printer. A media transport mechanism feeds media past a printing device applying print imaging and, eventually, through an output slot and onto an output tray of the printer. Thus, the user need not constantly feed individual sheet-form media into the printer.

Printers do not always apply print imaging to simple sheet-form media, e.g., single-panel ordinary paper stock. Printers frequently apply print imaging, e.g., addressing information, to envelopes. Envelopes come in a wide variety of sizes, including some recognized standard sizes. Envelopes have a more complex multi-panel structure as compared to simple sheet-form media. More particularly, envelopes serve as containers and have, typically, two planar sheet-form members comprising a front and back of the envelope as well as a flap structure selectively closing and opening in the envelope. Envelopes are thicker than ordinary sheet-form media. More complex envelope structures may contain two or more compartments, further adding to the overall thickness.

Fortunately, conventional media transport mechanisms in most printers handle the relatively more complex and thicker envelope structures. In other words, most printers typically have no significant problem feeding envelopes along a feed path and past a printing device. Thus, conventional media transport mechanisms are suitable for many envelope media.

Unfortunately, most printers do find challenge in collecting envelopes from a large stack of media. For example, most printers cannot handle very many envelopes stacked in a media input tray. As a result, printer users enjoy only limited benefit from automated media input sources such as a printer media input tray. Because such trays hold only a few envelopes, a user printing a significant number of envelopes must still handle many groups of such envelopes when replenishing the envelope supply in a conventional printer input tray. Furthermore, because media transport mechanisms collect the top member of a stack of media, printing operations must be interrupted to replenish from above a supply of media in a conventional printer input tray.

Many printers do include, however, an input slot receiving individual sheet-form media by manual placement therein. Input slots are commonly used for envelopes and special media, e.g., letterhead and special-form paper stock. Input slots support uninterrupted printing operations, i.e., a user can feed a series of media through the printer without stopping printing operations. Unfortunately, to achieve such uninterrupted printing operations the user must handle each and every individual item fed into the printer. Accordingly, input slots do not support automated media input and provide little convenience when a large number of items are to be fed into the printer.

In many applications, however, a user wishes to print multiple envelopes without manipulating individual envelopes. In other words, users often wish to print a large number of envelopes and find inconvenient the need to feed individual envelopes through a printer input slot or constantly replenish a media input tray. In some cases users may even dedicate a given printer to envelope operation and, even though printing one or just several envelopes at a given time, find inconvenient the need to individually feed envelopes or frequently replenish a media input tray.

Thus, printer users have a variety of choices with respect to printing operations applying print imaging to, for example, envelopes. There is always the single-feed method, but this requires excess, i.e., individual, envelope manipulation. A limited number of envelopes can be stacked in some printer input trays, however, the number of envelopes which can be stacked, i.e., replenished, at one time is limited. Furthermore, a print operation making use of a stack of envelopes in an input tray must be interrupted whenever the user replenishes the limited supply of envelopes in a printer tray. Accordingly, the act of replenishing itself introduces inefficiency and inconvenience into an overall printing operation.

Printers dedicated in design and operation to the exclusive task of envelope processing could be fashioned to satisfy need for large volume envelope print imaging operations. Unfortunately, many people having occasional need for such printing operations have no access to such dedicated high-production level envelope processing and print imaging devices. Accordingly, it would be desirable to better facilitate, i.e., make more efficient and convenient, the application of print imaging to, for example, envelopes making use of printing apparatus of substantially conventional and widely available design.

It would be desirable, therefore, to provide a printer capable of taking as an input source a stack of media of significant number whereby a user can print consecutively from such input source a relatively large number of media at one time or may occasionally print one or several such media without manipulating individual media and without interrupting printing operations.

SUMMARY OF THE INVENTION

A stack accessory for a printer under the present invention serves as a module attachable to a conventional printer. The accessory includes a stack receptacle. The stack receptacle has a feed side and a replenish side. The receptacle being open at its replenish side. A stack outlet located adjacent the feed side of the receptacle collects from the stack media and feeds media into a printer attached thereto. As a result, a generally conventional printer may be converted into a high-volume printer enjoying uninterrupted printing operations because media may be replenished without stopping printing operations.

The subject matter of the present invention is particularly pointed out and distinctly claimed in the concluding portion of this specification. However, both the organization and method of operation of the invention, together with further advantages and objects thereof, may best be understood by reference to the following description taken with the accompanying drawings wherein like reference characters refer to like elements.

BRIEF DESCRIPTION OF THE DRAWINGS

For a better understanding of the invention, and to show how the same may be carried into effect, reference will now be made, by way of example, to the accompanying drawings in which.

DETAILED DESCRIPTION OF THE PREFERRED EMBODIMENT

The present invention will be illustrated as a printer accessory attaching to a printer and providing as a media source a stack of envelopes. It will be understood, however, that a stack accessory according to the present invention may be employed to feed a variety of media types and media sizes including such media types and sizes as are typically fed through conventional or personal printing devices. The module is particularly useful, however, when used as a source of envelopes whereby the printer collects envelopes individually from the accessory, feeds individual envelopes through the printer, and delivers each envelope with print imaging thereon at the printer output. Because a relatively large number of envelopes may be stacked in the accessory, the user enjoys opportunity to print on a large number of envelopes without manipulating individual envelopes. Furthermore, and as described more fully hereafter, a printer accessory as provided under the present invention does not interrupt printer operation when a user replenishes a stack of media therein.

Figure 1:
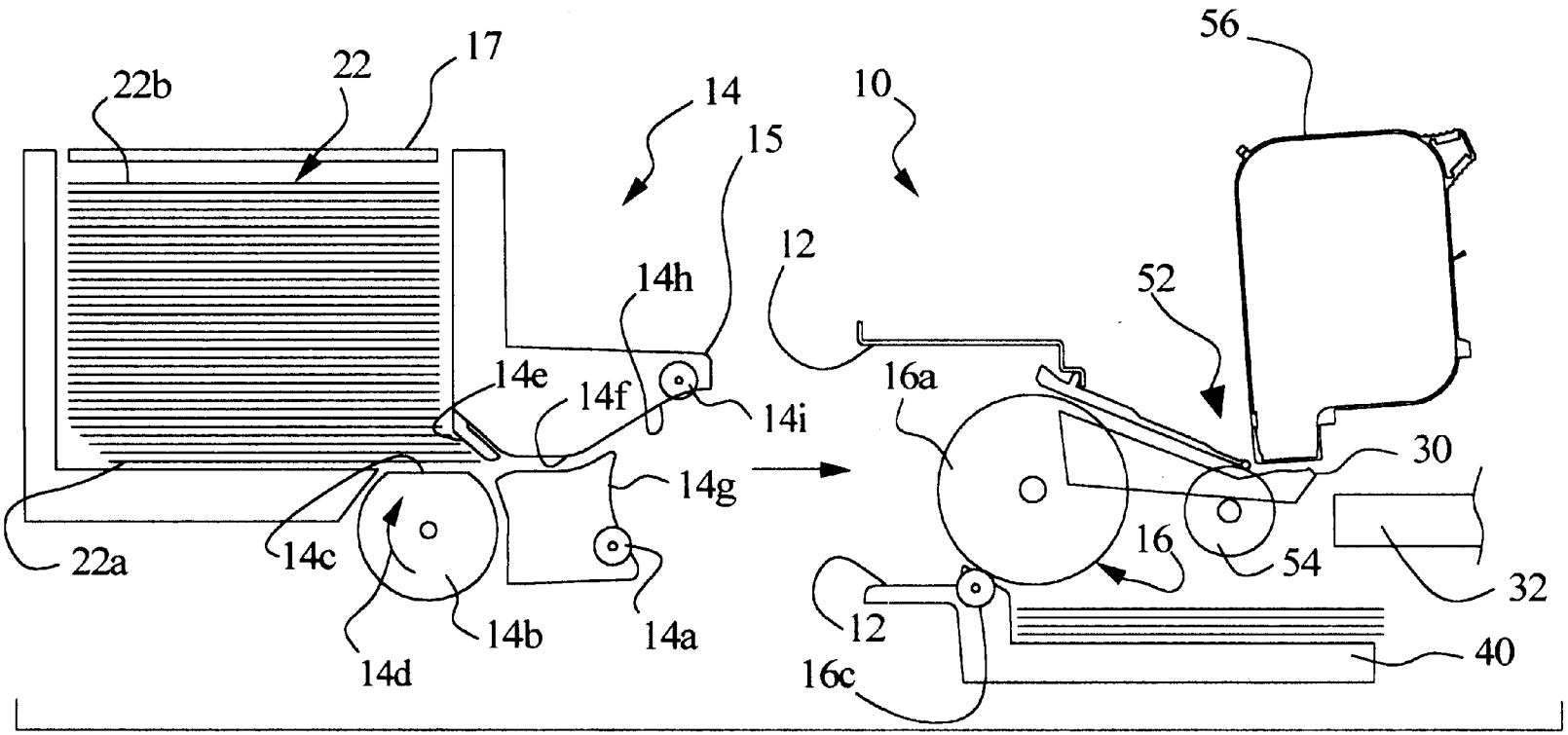
FIG. 1 illustrates schematically a printer and envelope stack accessory or media feed module according to a first embodiment of the present invention.
Figure 2:
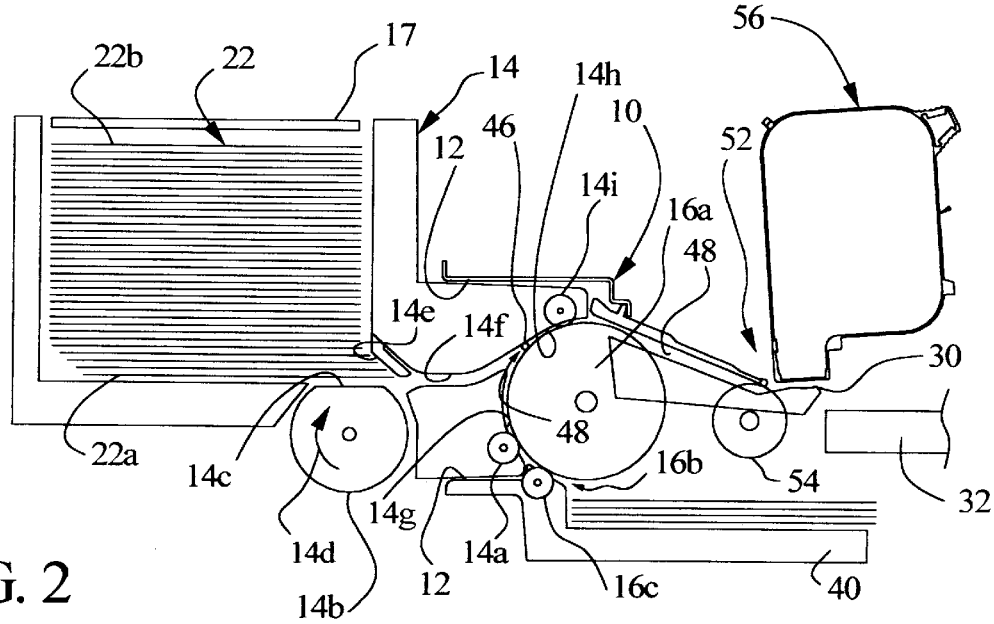
FIG. 2 illustrates the printer and the media feed module of FIG. 1 joined together during operation.

FIG. 1 illustrates schematically a printer 10 adapted for use in association with a stack accessory module 14 according to the present invention. In its basic design and operation, printer 10 is a substantially conventional printer. In other words, printer 10 includes a media transport path through a print zone and an output delivering media having print imaging applied thereto. In implementation of the present invention, however, printer 10 media feed mechanisms cooperate with structures of module 14 as shown herein. Printer 10 receives as an attachment the module 14 in implementation of the present invention, but as illustrated in FIG. 1, envelope module 14 is detached from printer 10. Printer 10 includes a rear opening 12 receiving a portion of module 14 therein for printing operations in accordance with the present invention. FIG. 2 illustrates module 14 as attached to printer 10 at rear opening 12 thereof.

Within printer 10, and adjacent opening 12, printer 10 includes a pick and feed mechanism 16. Module 14 presents a stack 22 of, for example, envelopes to printer 10. More particularly, module 14 presents to pick and feed mechanism 16 the bottom envelope 22*a* of stack 22. When activated, i.e., with module 14 selected as a media input source, printer 10 collects the bottom envelope 22*a* from module 14 and, in cooperation with mechanism 16, feeds bottom envelope 22*a* through printer 10 past a printing device 56, e.g., inkjet print cartridge 56, for application of print imaging thereon. Printer 10 then ejects envelope 22*a* at its output 30 onto an output tray 32. Printer 10 then collects a next envelope 22*a,* i.e., the new bottom envelope 22*a,* from module 14 and executes the next print imaging operation.

Because module 14 presents the bottom envelope 22*a* to mechanism 16, the top envelope 22*b* of stack 22 is the last envelope to be fed through printer 10. In other words, module 14 defines a stack receptacle having at its lower end a media outlet and characterized as being open at its upper end. This leaves available the "open" top of stack 22 for replenishing media thereon from above at any time without interrupting activity at the receptacle outlet, i.e., without interrupting printing operations collecting media from module 14. Accordingly, a user can at any time simply drop additional media onto stack 22 and thereby replenish module 14.

Printer 10 includes a standard input tray 40, e.g., a standard sheet-form media tray. With tray 40 selected as a media infeed device, module 14 contributes a portion of the feed mechanism in cooperation with pick and feed mechanism 16 of printer 10. Thus, printer 10 collects media from tray 40 and prints in conventional fashion with module 14 attached thereto. Because envelopes of stack 22 are of significantly greater thickness than standard sheet-form media, only a few envelopes would fit as a stack within tray 40. In accordance with the present invention, however, module 14 contains enough vertical space to hold a large number of envelopes in its stack 22, and thereby relieves a user of need to frequently replenish a stock of envelopes as input media for printer 10. Because a user can place media at the top of stack 22, the user need not wait for a print job to complete or even interrupt a print job to replenish a supply of media in stack 22.

In FIG. 2, pick and feed mechanism 16 includes a pick wheel 16*a*. Wheel 16*a* is selectively driven into rotation by control programming and circuitry of printer 10. Tray 40 includes conventional media support structures, i.e., a spring biased floor, to bring a stack of media in tray 40 into contact with pick wheel 16*a*. More particularly, the top member of a stack of media in tray 40 comes to bear against pick wheel 16*a*. Pick wheel 16*a,* upon rotation thereof, shears the top member of a stack of media in tray 40 and introduces it into a feed path 16*b*. Feed path 16*b* includes a rear-facing portion of the outer surface of pick wheel 16*a*. At the beginning of feed path 16*b,* a feed roller 16*c* urges media against wheel 16*a* and, therefore, into and along feed path 16*b*. In the particular embodiment illustrated herein, a second feed roller 14*a* lies along feed path 16*b,* the feed roller 14*a* also urges media against wheel 16*a* and, therefore, along path 16*b*. Roller 14*a,* however, is provided as a portion of module 14, i.e., when placed within rear opening 12 of printer 10. Module 14 also provides, with respect to feed path 16*b,* a guide surface 14*g*. Together, pick wheel 16*a,* roller 16*c,* roller 14*a,* and guide surface 14*g* establish a feed path and transport mechanism for media originating at input tray 40. Feed path 16*b* terminates at a feed path junction 46.

Media passes through junction 46 and enters feed path 48. Feed path 48 also follows an outer surface of wheel 16*a*. Module 14 contributes to path 48 a guide surface 14*h* and a roller 14*i* pressing media against wheel 16*a*. Wheel 16*a* and feed roller 14*i* cooperatively propel media onward along feed path 48 into a printing area 52 at the end of path 48. Feed drive wheel 54 supports and propels media out of printer 10 at outlet 30 onto output tray 32. As may be appreciated, printing area 52 may include a variety of devices, and in this particular embodiment, an inkjet print cartridge 56 projecting print imaging onto envelopes taken from stack 22.

Module 14 includes an envelope pick wheel 14*b*. Envelope pick wheel 14*b* includes a flat 14*c*. The purpose of flat 14*c* is to accommodate media of various sizes. More particularly, pick wheel 14*b*, about its rounded exterior surface exclusive of flat 14*c*, engages and propels media out of module 14 and into printer 10. As wheel 14*b* completes one rotation, flat 14*c* returns to its upward-facing position as illustrated in FIG. 1 and clears the path for, i.e., presents no resistance to, the trailing segment of media leaving module 14. In this manner, media initially taken from stack 22 and driven into printer 10 encounters no further resistance from wheel 14*b* once feed mechanisms downstream take over media transport. As wheel 14*b* rotates as indicated at 14*d*, its rounded surface engages a downward-facing surface of bottom envelope 22*a* and propels envelope 22*a* forward into an envelope separator pad 14*e*. Both wheel 14*b* and pad 14*e* are high friction materials. Accordingly, engagement of envelope 22*a* by wheel 14*b* moves envelope 22*a* forward into feed path 14*f*. Wheel 14*b* rotates once to feed an envelope from stack 22 into printer 10. Flat 14*c* insures that one and only one item of stack 22 enters feed path 14*f*. Envelope separator pad 14*e* engages other media in stack 22 above envelope 22*a* and blocks forward movement thereof into feed path 14*f*. Accordingly, as wheel 14*b* continues rotation, as indicated at reference numeral 14*d*, envelope 22*a* enters into and moves along feed path 14*f*. Eventually, envelope 22*a* reaches junction 46 and passes therethrough. Envelope 22*a* then moves into and along feed path 48 whereat feed wheel 14*i* engages envelope 22*a* and propels it further along feed path 48 for print imaging at printing area 52 and, eventually, exit at outlet 30. Wheel 14*b* returns to its orientation as indicated in FIGS. 1 and 2 in preparation for collecting the next envelope 22*a* from the bottom of stack 22 within envelope module 14.

Module 14 may be driven by gearing and transmission coupled to printer 10 or by an independent motor (not shown) provided in module 14 and operated in coordination with printer 10 operation.

Figure 3:
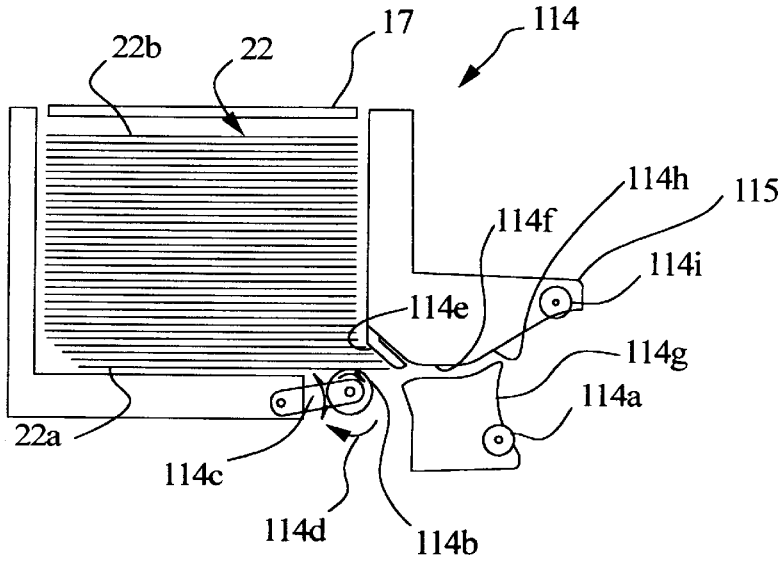
FIG. 3 illustrates schematically an alternative embodiment of a media feed module according to the present invention.

FIG. 3 illustrates an alternative stack accessory module 114. Module 114 is similar to module 14 in that it has structure accommodating entry into opening 12 of printer 10 and includes feed rollers 114*a* and 114*i* operating in conjunction with printer 10 to propel media through printer 10. Module 114 differs, however, in its use of a high friction pick wheel 114*b* of significantly smaller diameter and having no flat portion. Instead, high friction pick wheel 114*b* rests at the distal end of a reciprocating arm 114*c*. Reciprocation of arm 114*c* into an upper position brings wheel 114*b* into contact with the lower-facing surface of envelope 22*a*. This propels envelope 22*a* forward, into and under envelope separator pad 114*e* as wheel 114*b* rotates in the direction 114*d*. As a result, wheel 114*b* propels envelope 22*a* into feed path 114*f*. Moving lever arm 114*c* downward disengages contact with stack 22 and holds off further feeding of a bottom envelope 22*a* into feed path 114*f*. Wheel 114*b* need only propel an envelope 22 far enough to reach feed wheel 114*i* whereat feed wheel 114*i* carries the envelope 22*a* forward through printer 10. Thus, detecting an envelope 22*a* at wheel 114*i* provides a basis for moving, e.g., lowering, wheel 114*b* out of engagement with the stack 22. In other words, wheel 114*b* is selectively moved into and out of contact with members of stack 22 to selectively advance just bottom envelope 22*a* through printer 10 in coordination with printing operations.

Figure 4:
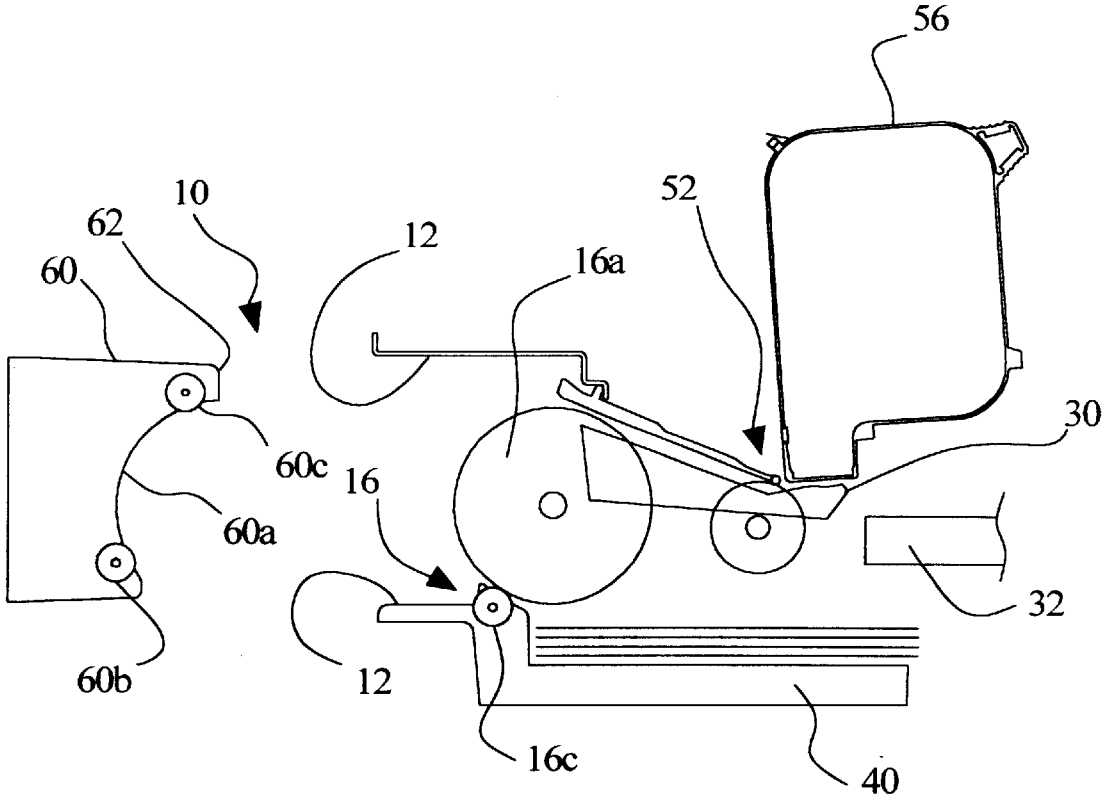
FIG. 4 (Prior Art)
FIG. 4 (Prior Art) illustrates conventional use of a printer when not attached to the stack accessory of FIGS. 1–3.

FIG. 4 (Prior Art) illustrates conventional use of printer 10 without module 14 installed, i.e., with a rear paper guide 60 installed. Rear paper guide 60 fits within opening 12 and provides a guide surface 60*a* and a pair of rollers, individually rollers 60*b* and 60*c*. With module 14 removed from printer 10, guide surface 60*a* together with rollers 60*b* and 60*c* complement pick and feed mechanism 16 of printer 10. Media taken from tray 40 moves between guide surface 60*a* and the rear-facing portion of pick wheel 16*a*. Media eventually passes along path 48 and past print area 52. As may be appreciated, printer 10 in its configuration illustrated in FIG. 4 serves well as a conventional printer. In other words, the technology and structures employed in the configuration of printer 10 as illustrated in FIG. 4 may be taken as a conventional printer in terms of its complexity and cost of manufacture. Under the present invention, however, printer 10 as illustrated in FIG. 4 may be converted into its configuration as illustrated in FIG. 2. In other words, rear paper guide 60 easily withdraws from printer 10 and module 14 easily fits in its place within opening 12.

Conventional printer 10 is thereby enhanced by its ability to feed media without individual manipulation of large quantities of media as taken from stack 22. Similar ease of conversion applies to module 114 as illustrated in FIG. 3. Furthermore, printer 10 now enjoys uninterrupted printing operations, i.e., printing operations need not be suspended to replenish a supply of media in stack 22.

While illustrated herein as holding envelopes, e.g., bottom envelope 22*a* and top envelope 22*b*, it will be understood that media stack 22 may include a variety of media types. In other words, modules 14 and 114 as described herein need not be limited in use to envelopes. Thus, in addition to managing a large supply of envelopes, a module 14 or 114 as described herein need not be limited to envelopes in its capacity as an automated infeed device. In this respect, modules 14 and 114 convert printer 10 into a higher volume printing device in that a constant supply of media may be applied to printer 10 without interruption associated with replenishing a media supply. In this regard, modules 14 and 114 may be configured to include movable wall structures as found in conventional infeed trays for the purpose of accommodating media of various custom or standard dimensions.

Modules 14 and 114 provide a further advantage in operation of printer 10 relative to other media feed arrangements. More particularly, media taken from stack 22 begins in a generally horizontal orientation and enjoys relatively less bending or buckling as compared to many paper feed mechanisms. Multi-panel media, e.g., envelopes, present a greater risk of buckling and potential media jam within a printer. As many printer users well understand, feeding envelopes through printers sometimes severely buckles envelopes, i.e., one panel of the envelope becomes severely crinkled. For example, consider printer 10 and its feed paths beginning at tray 40 and ending at printing area 52. Each media taken from tray 40 moves through more than a 180-degree turn. A large diameter pick wheel 16*a* defining the overall feed path radius of curvature reduces degradation of media passing therealong. Modules 14 and 114, however, present a relatively "flatter" overall feed path between modules 14 and 114 and printing area 52. As a result, envelopes fed from modules 14 and 114 have less likelihood of degradation or jamming. In other words, as media taken from stack 22 passes along feed path 14*f* it encounters a slight downward bend, but as it passes over the top of pick wheel 16*a* it encounters a slight opposite or upward bend. As a result, the two opposing feed path bends tend to rehabilitate media passing therethrough, i.e., cancel out buckling contributed by one another.

Figure 5:
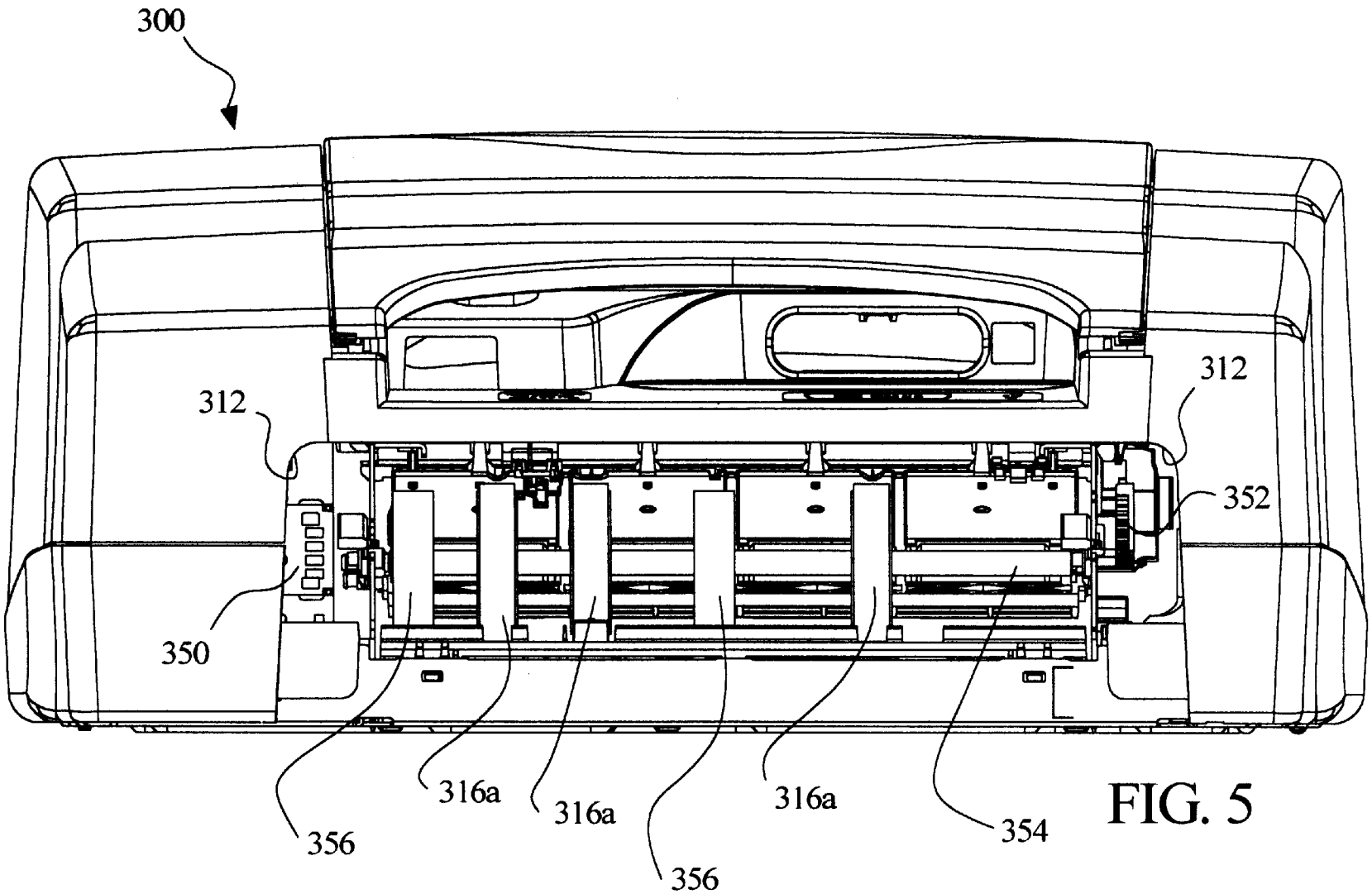
FIG. 5 illustrates in rear view a printer also capable of making use of a stack accessory according to the present invention.

FIG. 5 illustrates in rear view a conventional printer 300 suitable for use in conjunction with the present invention. Printer 300 as illustrated in FIG. 5 is generally similar to a DeskJet 970*c* or a DeskJet 930*c* model inkjet printer, both manufactured by The Hewlett-Packard Company. Printer 300 is configured at its rear opening 312 to receive a duplex module (not shown), i.e., a module mounted at opening 312 to facilitate duplex printing. Duplex printing applies print imaging to both sides of media. Accordingly, the duplex module attached (not shown) at opening 312 re-circulates and flips media to present opposite sides to a print imaging device. Printer 300 and the duplex module (not shown) attachable thereto are more fully illustrated and described in U.S. Pat. No. 6,167,231 entitled Print Recording Apparatus Having Modular Autoduplex Mechanism and issued Dec. 26, 2000; and in U.S. Design Pat. No. 431,046 entitled Modular Duplexing Module For An Inkjet Printing Mechanism issued Sep. 19, 2000.

In the preferred form of the present invention, it is suggested that modules 14 and 114 connect by suitable gearing to printer 10 or printer 300 to operate feed mechanisms 14*b* and 114*b*, respectively. In other words, a mechanical coupling between the feed mechanisms of modules 14 and 114 driven by gearing of printers 10 and 300. As may be appreciated, however, modules 14 and 114 may be provided with internal drive systems, i.e., electrical motors and associated gears coupled to devices 14*b* and 114*b*. As such, printers 10 and 300 would simply provide control signals to modules 14 and 114 in order to collect from modules 14 and 114 a sequence of media fed thereby.

With reference to FIG. 5, rear opening 312 provides opportunity for access to an electrical interface 350 and a gear 352. More particularly, opportunity for interfacing a module 14 or module 114 with printer 300 in implementation of the present invention, i.e., coordinated media feed and printing operations. Printer 300 includes a pick shaft 354. Shaft 354 carries thereon a pair of wheels 356 for controlling envelope transport. Shaft 354 also carries three pick wheels 316*a*. As may be appreciated, gear 352 comprises a portion of gearing used to drive shaft 354. Thus, control circuitry and programming of printer 300 selectively operate gear 352. In the particular embodiment of the present invention illustrated in FIG. 5, however, a module 14 couples to gear 352 to drive media feed mechanisms thereof as described more fully hereafter.

Figure 6:
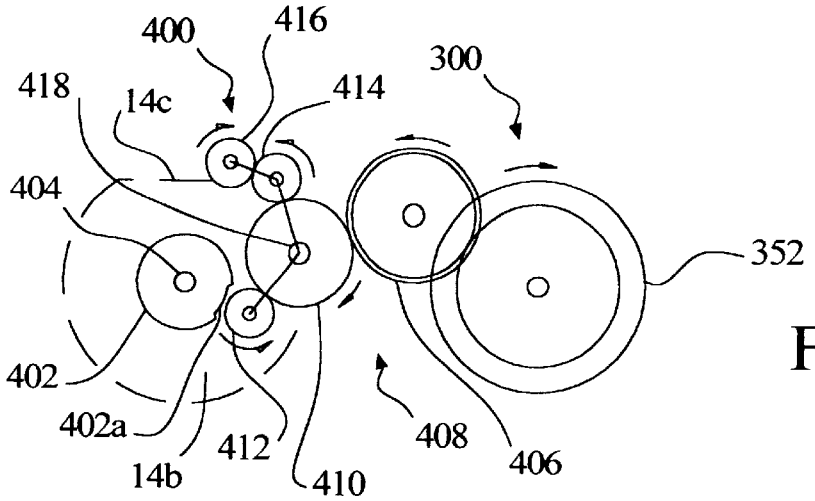
FIGS. 6–8 illustrate a mechanical interface suitable for driving a stack accessory relative to the printer of FIG. 5.
Figure 7:
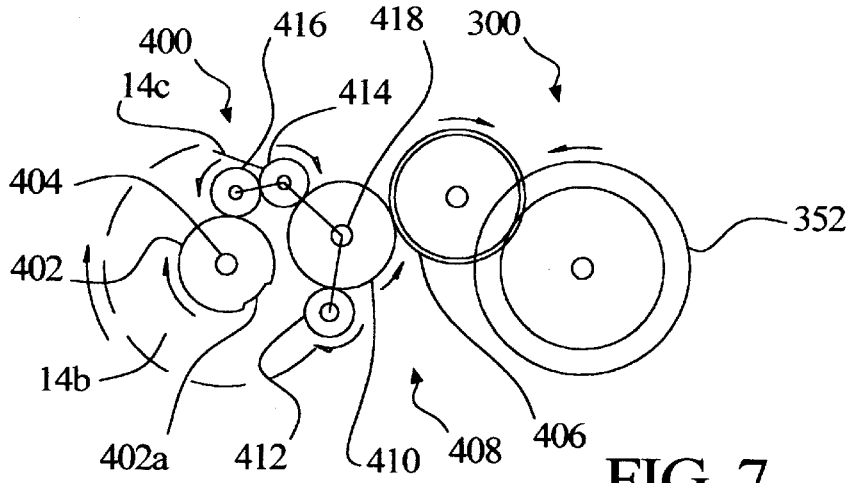
Figure 8:
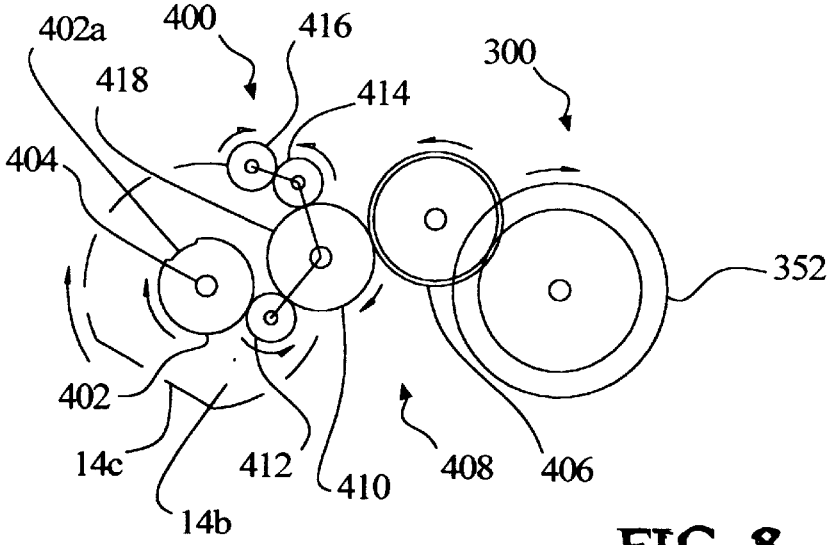

FIGS. 6–8 illustrate a drive system for media feeding in accordance with one aspect of the present invention. In FIGS. 6–8, gear 352 of printer 300 is illustrated as coupled to a gear train 400 of a stack accessory, e.g., module 14 as described herein. In this particular example, gear train 400 drives pick wheel 14*b* of module 14. FIG. 6 illustrates normal printing, i.e., when tray 40 is selected as a media input device. In this mode, forward rotation, clockwise in the view of FIGS. 6–8, of gear 352 results in no rotation of wheel 14*b* and, therefore, no media taken from module 14. More particularly, a drive gear 402 carried on wheel 14*b* drive shaft 404 includes a blank 402*a*. Blank 402*a* is a circumferential section of gear 402 having no teeth.

Gear train 400 includes a transfer gear 406 coupled to gear 352 of printer 300. Transfer gear 406 drives a pivoting transmission 408. Transmission 408 selectively drives gear 402 and, therefore, selectively drives wheel 14*b* of module 14. Transmission 408 includes a primary gear 410 coupled to, i.e., driven by, transfer gear 406. A set of drive gears mount in fixed relative orientation relative to gear 410. More particularly, a drive gear 412 couples directly to gear 410. Gear 414 couples directly to gear 410 and drives gear 416. Transmission 408, i.e., gears 410–416, pivots or toggles about a pivot shaft 418. With transmission 408 in a first position, i.e. as illustrated in FIG. 6, drive gear 412 is positioned for engagement with drive gear 402. In a second orientation, i.e., as illustrated in FIG. 7 and discussed more fully hereafter, transmission 408 positions drive gear 416 for engagement with drive gear 402.

Thus, with transmission 408 positioned as illustrated in FIG. 6 drive gear 412 is positioned adjacent drive gear 402. However, with blank 402*a* positioned adjacent gear 412 gear train 400 imparts no rotation to shaft 404 and, therefore, pick wheel 14*b* does not rotate during normal printing operations.

Normal printing operations include gear 352 rotating clockwise in the view of FIG. 6. This drives transfer gear 406 into counterclockwise rotation and shifts transmission 408 into its orientation as illustrated in FIG. 6. Thus, so long as gear 352 rotates clockwise, transmission 408 moves to its position as illustrated in FIG. 6 and, with blank 402*a* suitably positioned, imparts no rotation to wheel 14*b*.

FIG. 7 illustrates toggling of transmission 408 into its alternative position, i.e., an initial position rotating wheel 14*b* for feeding media from module 14. Thus, with gear 352 rotating counterclockwise as viewed in FIG. 7, gear 406 rotates clockwise and thereby pivots gear 410 counterclockwise. This causes gear 412 to move away from gear 402 and to bring gear 416 into engagement with gear 402. As a result, gear 402 rotates shaft 404 and drives wheel 14*b* into clockwise rotation. This begins feeding of media from module 14.

Counterclockwise rotation of gear 352 continues sufficiently to position blank 402*a* past its engagement point with gear 412. At this point, gear 352 returns to clockwise rotation as illustrated in FIG. 8. This clockwise rotation of gear 352 drives gear 406 into counterclockwise rotation and toggles transmission 408 placing gear 412 into engagement with gear 402. Clockwise rotation of wheel 14*b* continues and, therefore, media continues to move under engagement with wheel 14*b* from module 14 into printer 300. Clockwise rotation of gear 352 continues and media feeding continues until blank 402*a* of gear 402 reaches gear 412. As may be appreciated, this both stops rotation of wheel 14*b* and repositions wheel 14*b* for a next media engagement, i.e., positions flat 14*c* in its upper position facing a downward-facing surface of bottom envelope 22*a*.

Thus, printer 300 control circuitry and programming may be adapted in its media feed procedures when module 14 is selected an input device. More particularly, to accomplish media feeding, printer 300 first reverses gear 352, i.e., counterclockwise in the view of FIGS. 6–8, and toggles transmission 408 to begin rotation of wheel 14*b*. Once sufficiently driven in counterclockwise direction, i.e., sufficient to move blank 402*a* out of its gear 412 engagement point, printer 300 reverses operation of gear 352, i.e., drives it in a clockwise direction in the view of FIGS. 6–8. This toggles transmission 408 into its alternative position, but continues moving wheel 14*b* in its media-feed rotational directional, i.e., clockwise in the view of FIGS. 6–7. Overall, therefore, wheel 14*b* moves through one rotation beginning with flat 14*c* at its upper position and ending with flat 14*c* at its upper position.

Modules 14 and 114 can include an identification interface 15 and 115, respectively. Similarly, paper guide 60 can include an identification interface 62 (FIG. 4). A duplex module (not shown) can include a similar identification interface. An identification interface may be implemented according to a variety of methods, e.g., a particular surface contour or set of contact pins having particular resistance therebetween. Thus, a set of electrical pins suitably positioned on module 14 to contact electrical interface 350 of printer 300 allows electrical interface 350 to "read" or identify what module is attached to printer 300. Generally an identification interface provides printers 10 and 300 with indication of the type of device presently attached to opening 12 or 312, respectively. In other words, a module placed within openings 12 and 312 should identify to printers10 and 300 its capabilities. In response, print operations making use of that module take into account its capabilities and particular requirements in order to, in the case of modules 14 and 114, collect individual media from a media stack 22 held thereby.

As described herein, modules 14 and 114 may be replenished at any time by placing additional media within the stack receptacle defined thereby. So long as sufficient media rests within modules 14 and 114, wheels 14*b* and 114*b*, respectively, carry sufficient pressure to develop sufficient friction to drive media out of modules 14 and 114. When the supply of media is sufficiently low, however, insufficient weight of media may exist within modules 14 and 114 to develop enough friction to propel media therefrom. Accordingly, a weighted plate 17 may be placed upon the top member of stack 22 as illustrated FIGS. 1, 2, and 3. The mass of plate 17 may vary according to particular applications. Plate 17 may not be necessary when constantly replenishing media within modules 14 and 114, but may be employed where the potential for exhausting a supply of media within modules 14 and 114 exists.

Pick wheels 14*b* and 114*b* need be dimensioned and operated through sufficient rotation to propel a media sufficient distance for engagement by a next portion of the feed system. In other words, pick wheel 14*b* should be dimensioned such that a complete rotation thereof propels media sufficiently to engage roller wheel 14*i*. Thereafter, roller wheel 14*i* and feed wheel 16*a* further propel media along its feed path. Similar dimensioning and amount of rotation issues apply to module 114 to send for each activation of wheel 114*b* media from stack 22 sufficient distance to reach wheel 114*i* where after media is carried further without aid of wheel 114*b*. As noted above, wheel 114*b* should be withdrawn from its upper position once media reaches wheel 114*i*. This reduces drag on media when pulled forward by wheel 114*i*.

Thus, an improved infeed device for a printer has been shown in described. The infeed device of the present invention takes advantage in its distinction between a replenishing side of a media stack and a feed side of a media stack. In the particular embodiment illustrated herein, modules 14 and 114 collect media from a stack 22 at one side of the stack 22, but permit replenishing of media at the other side of stack 22. In other words, feeding occurs at the bottom of stack 22 and replenishing occurs at the top of stack 22. As a result, and depending on the dimensions of a particular module 14 or 114, a large number of media may be placed as a stack 22 therein. Users enjoy convenient and uninterrupted printing operations. Printing operations are convenient because a large number of media may be placed in a given stack 22. Printing operations are uninterrupted because when a stack 22 needs to be replenished, it is replenished on an opposite side thereof relative to the feeding side of a stack 22. Accordingly, printing operations need not be interrupted to replenish a media stack 22.

Furthermore, an improved infeed system according to the present invention supports conversion of a conventional printer to a high-volume printer enjoying uninterrupted printing operations because media may be replenished without stopping printing operations. Thus, persons having possession of a conventional printer, e.g., printer 300, can obtain at relatively little expense a stack accessory as provided under the present invention to convert the conventional printer into a more useful higher-volume printing device having large media capacity and ability to conduct continuous printing operations without interruption associated with replenishing media.

It will be appreciated that the present invention is not restricted to the particular embodiment that has been described and illustrated, and that variations may be made therein without departing from the scope of the invention as found in the appended claims and equivalents thereof.

What is claimed is:

1. An infeed module for a printer, said printer including a module mounting site, said infeed module comprising:

a mounting structure attachable at said mounting site of said printer;

a media stack receptacle, said stack receptacle having a feed side and a replenish side, said stack receptacle being open at said replenish side; and a stack outlet adjacent said feed side of said stack receptacle, said stack outlet presenting media externally of said module, said stack outlet of said module including a high friction surface engaging through movement thereof media held in said stack receptacle, said movement of said high friction surface being driven mechanically by said printer, said module mounting site of said printer including in at least one of exposed or exposable first gear, said module including a complementary second gear positioned for engaging said first gear when said module is attached to said printer at said module mounting site.

2. A method of printer operation, said printer including a media transport mechanism, said method comprising the steps:

removing a first portion of said media transport mechanism;

inserting a stack accessory in place thereof, said stack accessory feeding media from a stack receptacle having a feed side and a replenish side, said stack receptacle being open at its replenish side and feeding media taken from said stack receptacle at its feed side, said stack accessory complementing a second portion of said media transport mechanism of said printer to selectively feed media from said stack accessory and through said printer, said method of printer operation coupling mechanically said stack accessory to said printer to drive operation of said stack accessory in propelling media therefrom.

* * * * *